US006772832B2

(12) United States Patent
Schneider

(10) Patent No.: US 6,772,832 B2
(45) Date of Patent: Aug. 10, 2004

(54) HEAT EXCHANGER TUBE SUPPORT BAR

(75) Inventor: William G. Schneider, Cambridge (CA)

(73) Assignee: Babcock & Wilcox Canada, Ltd., Cabridge (CA)

( * ) Notice: Subject to any disclaimer, the term of this patent is extended or adjusted under 35 U.S.C. 154(b) by 0 days.

(21) Appl. No.: 10/127,912

(22) Filed: Apr. 23, 2002

(65) Prior Publication Data

US 2003/0196786 A1 Oct. 23, 2003

(51) Int. Cl.[7] ..... F28F 9/00; F28F 9/04

(52) U.S. Cl. ..... 165/162; 165/178; 165/69; 165/76

(58) Field of Search ..... 165/162, 178, 165/82, 76, 69; 248/68.1; 122/510, 511; 110/325; 376/462

(56) References Cited

U.S. PATENT DOCUMENTS

| | | | | |
|---|---|---|---|---|
| 2,175,555 A | * | 10/1939 | Brown | 122/510 |
| 2,853,278 A | | 9/1958 | Hesler | |
| 3,007,679 A | | 11/1961 | Byerley et al. | |
| 3,422,884 A | * | 1/1969 | Otten | 165/79 |
| 3,503,440 A | * | 3/1970 | Romanos | 122/510 |
| 3,575,236 A | | 4/1971 | Romanos | |
| 3,782,455 A | * | 1/1974 | Wolowodiuk et al. | 165/162 |
| 3,854,529 A | * | 12/1974 | Sagan | 165/162 |
| 4,184,862 A | * | 1/1980 | Waters | 165/162 |
| 4,220,199 A | * | 9/1980 | Romanos | 165/162 |
| 4,605,059 A | * | 8/1986 | Page | 248/68.1 |
| 4,653,576 A | | 3/1987 | Lagally | |
| 4,720,840 A | | 1/1988 | Lagally et al. | |
| 4,747,373 A | | 5/1988 | Wepfer et al. | |
| 4,789,028 A | | 12/1988 | Gowda et al. | |
| 4,860,697 A | | 8/1989 | Malaval | |
| 4,893,671 A | | 1/1990 | Lagally et al. | |
| 4,895,204 A | | 1/1990 | Johnson et al. | |
| 4,991,645 A | | 2/1991 | Lagally et al. | |
| 5,005,637 A | | 4/1991 | Gentry | |
| 5,072,786 A | | 12/1991 | Wachter | |
| 5,127,469 A | | 7/1992 | Boula | |
| 5,515,911 A | | 5/1996 | Boula et al. | |
| 6,367,430 B1 | * | 4/2002 | Schneider | 122/510 |

OTHER PUBLICATIONS

*Steam*, Its Generation and Use, 40th Edition, The Babcock & Wilcox Company, ©1992, Chapter 52 Nuclear Equipment Manufacture, p. 52–5.

* cited by examiner

*Primary Examiner*—Henry Bennett
*Assistant Examiner*—Tho V Duong
(74) *Attorney, Agent, or Firm*—Kathryn W. Grant; Michael J. Seymour; Eric Marich

(57) ABSTRACT

A support bar for tubes in a heat exchanger, such as the U-bend tubes in the U-bend region of a recirculating, nuclear steam generator, provides positive restraint in both the in-plane direction of the tube planes and the out-of-plane direction. The bar has pairs of parallel surfaces aligned with first and second axes such that the bar may be positioned with either axis arranged parallel to the tube planes. The bar can be used in place of other types of tube support bars, and can also be used as an auxiliary bar for installation into a fully assembled heat exchanger to provide additional support to supplement other tube support arrangements.

23 Claims, 4 Drawing Sheets

HEAT EXCHANGER TUBE SUPPORT BAR

FIELD AND BACKGROUND OF INVENTION

The present invention relates generally to the field of heat exchanger tube supports, and in particular to a new and useful tube support bar for restraining and positioning the U-bends of water tubes within a nuclear steam generator.

In a pressurized water nuclear power station, steam generators, which are large heat exchangers, transfer heat, produced via nuclear reactions in the reactor core, from a primary water coolant to a secondary water coolant that drives the steam turbine. The primary coolant is pressurized, which allows the primary water coolant to be heated in the reactor core with little or no boiling. For example, in a light water reactor, the primary coolant is pressurized to about 2250 psia and heated to about 600 deg F. in the reactor core. From the reactor, the primary water coolant flows to a steam generator, where it transfers heat to the secondary coolant. In a U-tube, or recirculating steam generator, the primary coolant enters at the bottom of the steam generator, flows through tubes having an inverted U-shape transferring heat to the secondary coolant, and then exits at the bottom of the steam generator. The secondary coolant is pressurized only to a pressure below that of the primary side, and boils as it flows along the outside of the tubes, thereby producing the steam needed to drive the turbine. Nuclear steam generators must be capable of handling large quantities of two-phase secondary coolant moving at high flow rates, and are therefore very large structures. For example, a nuclear U-tube steam generator can weigh more than 450 tons, with a diameter exceeding 12 feet and an overall length of greater than 70 feet. It may contain as many as 9,000 or more of the long, small diameter, thin-walled U-shaped tubes. For a general description of the characteristics of nuclear steam generators, the reader is referred to Chapters 47 and 52 of *Steam/Its Generation and Use*, 40th Edition, The Babcock & Wilcox Company, Barberton, Ohio, U.S.A., ©1992, the text of which is hereby incorporated by reference as though fully set forth herein.

Heat exchangers such as nuclear steam generators require tube restraints or supports, to position the tubes and to restrain the tubes against flow induced vibration forces. In the U-bend region of a nuclear steam generator, a large flow of steam and water mixture passes upwards through the tube array, in a general direction which locally is normal to the axis of the individual U-bend tubes. This large two phase flow is able to cause excitation of the U-bend tubes via the turbulent and other flow forces imparted by the flow. As a result, the tubes tend to vibrate in both the out-of-plane and in-plane directions relative to the U-bend plane. Typically this restraint function is provided by an array of flat U-bend support bars. While such flat bars provide positive restraint in the U-bend out-of-plane direction, they provide restraint only by friction in the in-plane direction.

One known type of nuclear steam generator U-bend support, depicted in FIG. 1, and in greater detail in FIG. 2, is manufactured by Babcock & Wilcox Canada Ltd. FIG. 1 shows a nuclear steam generator 100 having a plurality of U-bend tubes 110. The U-bend tubes 110 are arranged in layers, with each layer having multiple tubes all positioned within the plane of their respective U-bends. Each layer incorporates a set of tubes of successively larger radius which are nested to create the layer of tubes in the particular plane. For purposes of illustration, however, FIG. 1 shows only a limited number of U-bend tubes 110, and FIG. 2 shows only the outermost tubes of the center U-bend layers. The straight leg portions of the U-bend tubes 110 are supported at several locations by vertically spaced apart tube support plates 200, as shown in FIG. 1.

As shown in FIG. 1, and in greater detail in FIG. 2, the U-bend tubes 110 are positioned and restrained in the U-bend region by a U-bend support assembly 120 which includes a number of U-bend support bar arrays 180. Each U-bend support bar array 180 is comprised of flat U-bend support bars 160, which are positioned in sets between layers of tubes within the U-bend region of the steam generator. The flat U-bend support bars 160 fan out from the center of the U-bend such that individual bar sets are assembled into a U-bend support bar array 180, or "fan" bar array, in which the lower ends of the individual bars are interconnected. As shown in FIG. 2, the inner ends of the flat U-bend support bars 160 of a particular U-bend support bar array 180, are interconnected by a mechanical or welded joint 210. Each U-bend support bar array 180 incorporates about 4 to 12 of the flat U-bend support bars 160. The flat U-bend support bars 160 are positioned so as to provide support to the U-bend tubes 110 at certain points along the arc of each U-bend tube in the array. The angular separation of the flat U-bend support bars 160 depends upon the U-bend size and flow conditions, and the flat U-bend support bars 160 are located to minimize unsupported tube lengths. The individual flat U-bend support bars 160 are typically made of stainless steel, and are about 1" to 1.5" wide and about 0.1" to 0.2" thick. A U-bend support assembly 120 may incorporate 100 to 200 of the fan-shaped U-bend support bar arrays 180, with one such array located between each plane of U-bend tubes. The outer ends of the flat U-bend support bars 160 are collected, restrained and supported by arch bar support structures 170 located adjacent the steam generator U-bend. Each arch bar support structure 170 positions the flat U-bend support bars 160 of a U-bend support bar array 180, carrying the weight of the bars and redistributing the weight of the U-bend support assembly 120 back to the peripheral layer of U-bend tubes.

The U-bend support bar arrays 180 position the planes of U-bend tubes 110 in space, and most importantly, restrain the individual U-bend tubes against flow induced vibration. Restraint against out-of-plane motion is provided by the physical presence of the flat U-bend support bars 160, which are situated immediately adjacent to the U-bend tubes 110. The bar-to-tube clearance is purposely quite small, with the bar-to-tube diametral clearance varying from about 0 to 0.010" or more. The flat U-bend support bars 160, with their small bar-to-tube clearances, thus prevent significant motion of the tubes in the out-of-plane direction 140. In the in-plane direction 130, however, the U-bend tubes 110 are not positively restrained, but instead depend solely upon friction between the U-bend tubes 110 and the flat U-bend support bars 160 to restrict and dampen the flow induced motion of the tubes in their in-plane direction. Depending on the design details and flow conditions, the effect of the friction in providing in-plane restraint may not be fully adequate in providing in-plane restraint.

SUMMARY OF INVENTION

The present invention is drawn to an improved heat exchanger tube support bar which is particularly suited for the U-bend region of a U-tube nuclear steam generator. The bar is configured so that it has scalloped pockets on opposite surfaces of the bar, which can be positioned to engage and restrain the tubes during steam generator operation. Each pocket is arranged so that it provides a support surface for a tube. As the tube is supported on each side by one of these pockets with close clearance, the tube is positively constrained in its out-of-plane direction by virtue of the small tube-to-bar clearance, and positively supported in the in-plane direction by the contour of the pocket as it engages with the U-tube.

The support bar has a thin profile width section whereby the bar may be positioned within an existing tube array in two different orientations, i.e. with either the diagonal or vertical cross sectional axes of the bar positioned parallel to the plane of the tubes. In the diagonal orientation, the bar may be moved, as for installation, within the space between layers of tubes without restriction. With the pocketed bars correctly positioned, and with the pocketed bars rotated to the vertical orientation, pockets along the diagonally opposite shoulder areas of the bars are able to positively position the tubes in both in-plane and out-of-plane directions for purposes of providing restraint of the tubes against flow induced vibration.

Accordingly, one aspect/object of present invention is to provide an improved heat exchanger tube support bar providing support in both the in-plane and out-of-plane directions.

It is a further aspect/object of the present invention to provide an improved U-bend support bar which reduces the susceptibility of the tubes in the U-bend region to flow induced vibration and tube fretting at the support locations.

It is an object of one embodiment of the invention to provide a U-bend support bar to serve in place of one or more of the U-bend support bars within a particular U-bend support bar array, either as a retrofit or during new equipment manufacture.

It is an object of an alternate embodiment of the invention to provide an auxiliary U-bend support bar for installation within an existing U-bend support bar array, either as a retrofit or during new equipment manufacture.

Accordingly one aspect of the invention comprises a support bar, for use in a heat exchanger having rows of tubes arranged in a plurality of parallel tube planes defining an in-plane direction and an out-of-plane direction, the support bar having an elongated body with first and second sides, and first and second ends; a first shoulder, extending along the first side adjacent the first end, and having a first plurality of pockets adapted for receiving a first row of tubes; a second shoulder, extending along the second side adjacent the second end, and having a second plurality of pockets adapted for receiving a second row of tubes; and wherein the pockets are designed to have a small clearance with the tubes after installation thereby restraining the tubes against motion in both the in-plane direction and the out-of-plane direction.

Another aspect of the invention comprises a support bar, for use in the U-bend region of a heat exchanger having rows of U-bend tubes arranged in a plurality of parallel U-bend tube planes defining an in-plane direction, and an out-of-plane direction, the support bar having an elongated body with first and second sides, and first and second ends, the body having a cross sectional form generally in the shape of a parallelogram having a short diagonal and a long diagonal, a center located at the intersection of the short diagonal and the long diagonal, a first axis passing through the center, a first pair of parallel surfaces located on opposite sides of the first axis, a second axis passing through the center, and a second pair of parallel surfaces located on opposite sides of the second axis; a first shoulder, extending along the first side adjacent the first end, and having a first plurality of pockets adapted to restrain a first row of U-bend tubes against motion in both the in-plane direction and the out-of-plane direction in the U-bend region; and a second shoulder, extending along the second side adjacent the second end, and having a second plurality of pockets longitudinally offset from the first plurality of pockets and adapted to restrain a second row of U-bend tubes against motion in both the in-plane direction and the out-of-plane direction in the U-bend region; and wherein the first and second shoulders each have shoulder sides parallel to the second axis, and inner and outer shoulder end surfaces perpendicular to the first axis.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
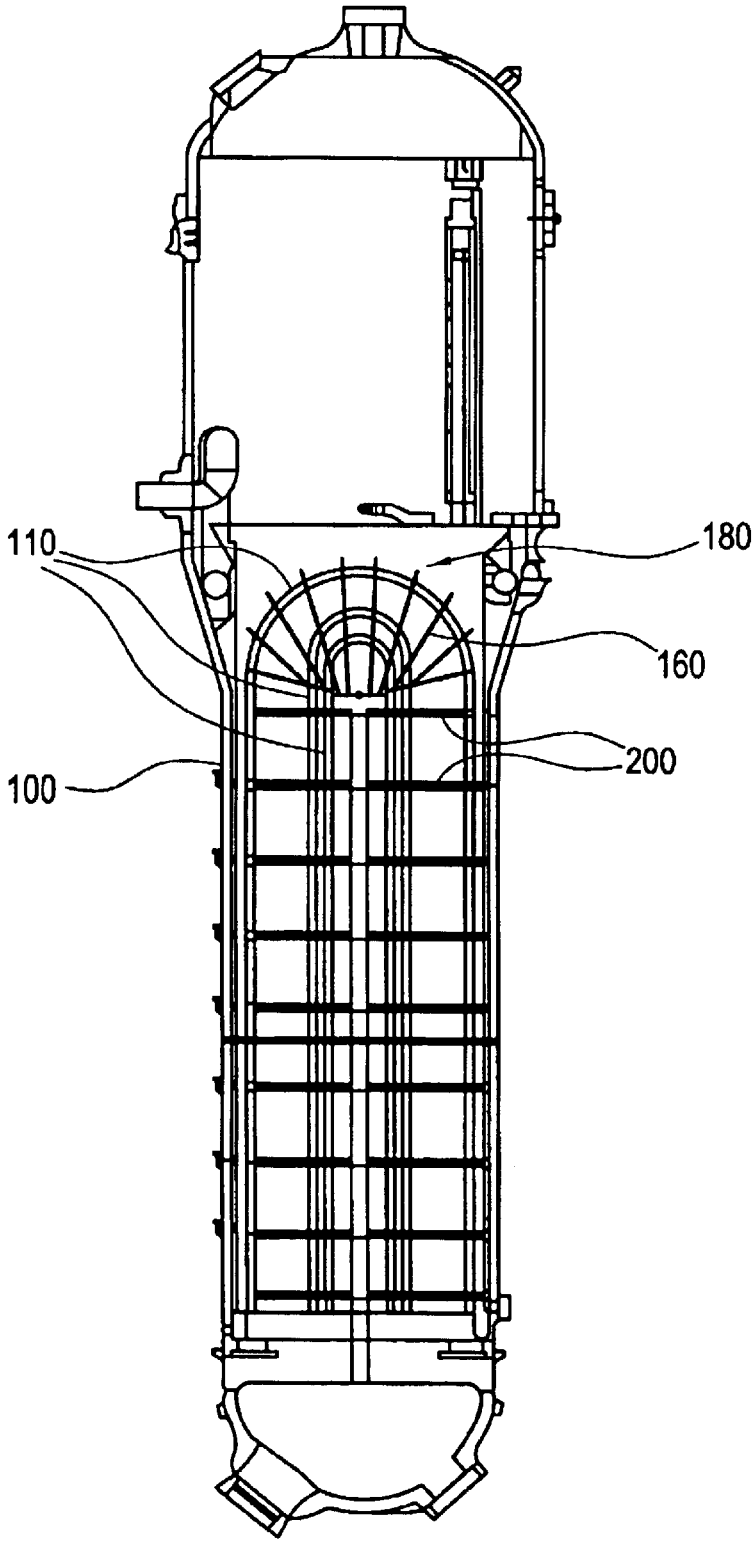
FIG. 1 is a sectional front elevation view of a nuclear steam generator where the pocketed tube support bars of the invention may be used.
Figure 2:
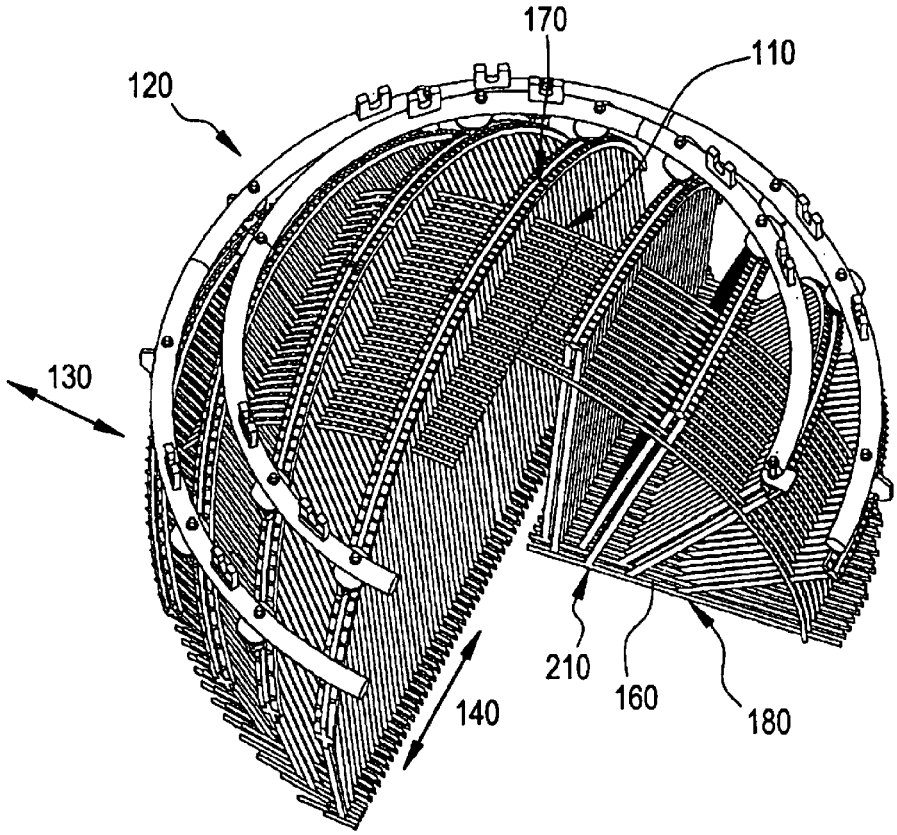
FIG. 2 is a partially cut away perspective view of a known U-bend support assembly.
Figure 3:
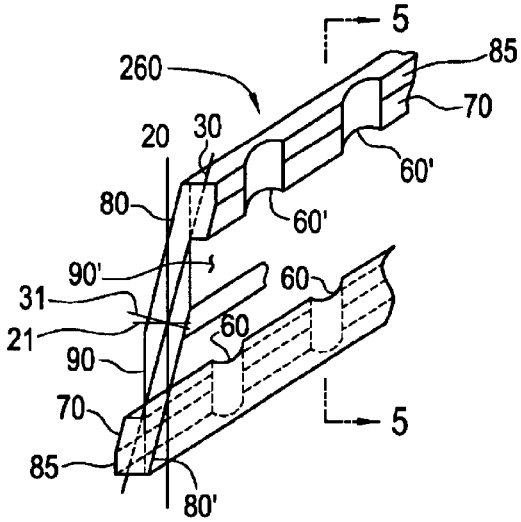
FIG. 3 is a perspective view of an end section of the improved tube support bar of the present invention.

Referring to the drawings in which reference numbers are used to refer to the same or functionally similar elements, FIG. 3 shows a portion of an improved tube support bar 260 according to the present invention.

Figure 5:
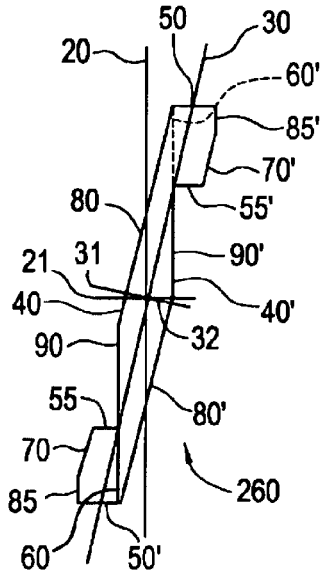
FIG. 5 is a cross sectional view of the improved tube support bar of the present invention.
Figure 4:
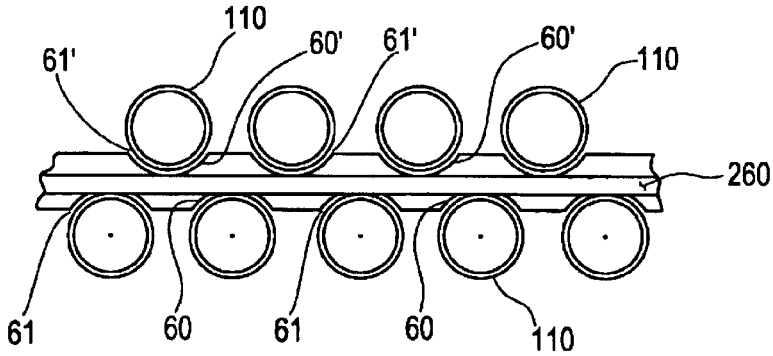
FIG. 4 is a partial plan view of the improved tube support bar of the present invention.

The detailed features of the pocketed tube support bar 260 are shown in FIGS. 3–5. FIGS. 3 and 5 both show that the general shape of the cross section of the pocketed tube support bar 260 resembles the letter "Z." In the following description the central and extremity portions of the Z-shape will be referred to as the body and the shoulders, respectively. The body is roughly in the shape of a parallelogram having a long diagonal and a short diagonal, shorter than the long diagonal, wherein the diagonals meet at the center of tube support bar 260.

As shown in FIG. 5 the cross sectional shape of the pocketed tube support bar 260 is defined primarily by two axes passing through the center of the pocketed tube support bar 260; a first axis 20, shown in, but not limited to, the vertical orientation, and a second, diagonal axis 30 at an angle to axis 20.

The body of the pocketed tube support bar 260 incorporates a first pair of surfaces, 90 and 90', aligned in parallel with, and arranged on opposites sides of, the first axis 20, and also incorporates a second pair of surfaces, 80 and 80', aligned in parallel with, and arranged on opposites sides of, the second, diagonal axis 30. The body of the pocketed tube support bar 260 thus has the general shape of a long, thin parallelogram having a first side defined by surfaces 80–90 and a second side defined by surfaces 80'–90'. The body has first and second ends 50 and 50' located at the ends of sides 80 and 80' respectively.

Surfaces 80 and 80' intersect surfaces 90 and 90', respectively, on opposite sides of and adjacent to the center of the pocketed tube support bar 260. The intersections of surfaces 80–90 and 80'–90' are each provided with a blend radius 40 and 40', with the distance between the arcs of the radius being the same as the distance between the planes formed by the pairs of surfaces 80 and 80', and 90 and 90' respectively.

A line 32 which falls along axis 31 perpendicular to the second, diagonal axis 30, or along axis 21 perpendicular to first axis 20, or any direction between axes 21 and 31, and which passes through the center of the pocketed tube support bar 260 to connect the first side of the body (surfaces 80–40–90) with the second side of the body (surfaces 80'–40'–90'), sets the thickness of the pocketed tube support bar 260, and defines the thickness required for pocketed tube support bar 260 to serve as a flat tube support bar 160. This thickness is the same in all directions along axis 21 or axis 31 or any direction between axes 21 and 31. In this manner the pocketed tube support bar 260 can serve as a flat bar tube restraint with any bar orientation, i.e. with axis 20 or 30, or any axis in between, being parallel to the tube plane.

The thickness of the shoulders of the pocketed tube support bar 260 is defined by pairs of parallel surfaces 70–80' and 70'–80. Surfaces 70–80' and 70'–80 are respectively co-planar, aligned parallel with and located on opposite sides of the diagonal axis 30. The distance between surfaces 70–80' and 70'–80 in a direction perpendicular to the diagonal axis 30 is also equivalent to the maximum thickness of the pocketed tube support bar 260, which is set to equal the spacing between successive layers of tubes 110, less a small clearance.

The shoulders each have outer end surfaces 50 and 50', and inner end surfaces 55 and 55', which are perpendicular to the first axis 20, and are therefore parallel to each other. The shoulders of pocketed tube support bar 260 may also incorporate parallel shoulder side surfaces 85 and 85' aligned in parallel with, and arranged on opposites sides of, the axis 20 as shown in FIGS. 3 and 5.

As shown in FIGS. 3–5, there are pockets or scallops 60 and 60' within the shoulders of the pocketed tube support bar 260. Pockets 60 and 60' are arranged on the opposite sides of the pocketed tube support bar 260 such that when the pocketed tube support bar 260 is rotated so that surfaces 90 and 90' are parallel with the plane of the tubing, and more or less in contact with the tubes 110, the tubes 110 are nested in the individual pockets along the length of the pocketed tube support bar 260.

FIG. 4 provides a plan view of the pocketed tube support bar 260 looking in the direction parallel to the axes of the tubes 110 and perpendicular to the pocketed tube support bar 260. The figure shows two partial layers of tubes 110 in cross section, with the first layer nested into pockets 60 and the second layer nested into pockets 60' on the opposite side of the pocketed tube support bar 260. Small clearances 61 and 61' may exist between the tubes 110 and the pockets 60 and 60'.

In one embodiment, the pocketed tube support bars 260 are designed to be positioned among the U-bend tubes within the U-bend region of a U-tube steam generator 100, and are oriented so the axes 20 of the bar cross sections are parallel to the space between layers of U-bend tubes. For this orientation the pockets of the pocketed U-bend support bars 260 would be nested to the respective tubes to provide positive restraint of the U-bend tubes in the in-plane direction 130 as well as the out-of-plane direction 140. The pocketed support bars 260 thus provide positive U-bend tube restraint in the in-plane direction, unlike flat bars, which provide restraint in the in-plane direction only by way of tube-to-bar friction.

In the above embodiment the outer ends of the pocketed tube support bars 260 are affixed, directly or indirectly, to an existing external support structure such as arch bars 170, either with or without being affixed to a special external structure for the pocketed tube support bars 260 themselves.

Figure 6:
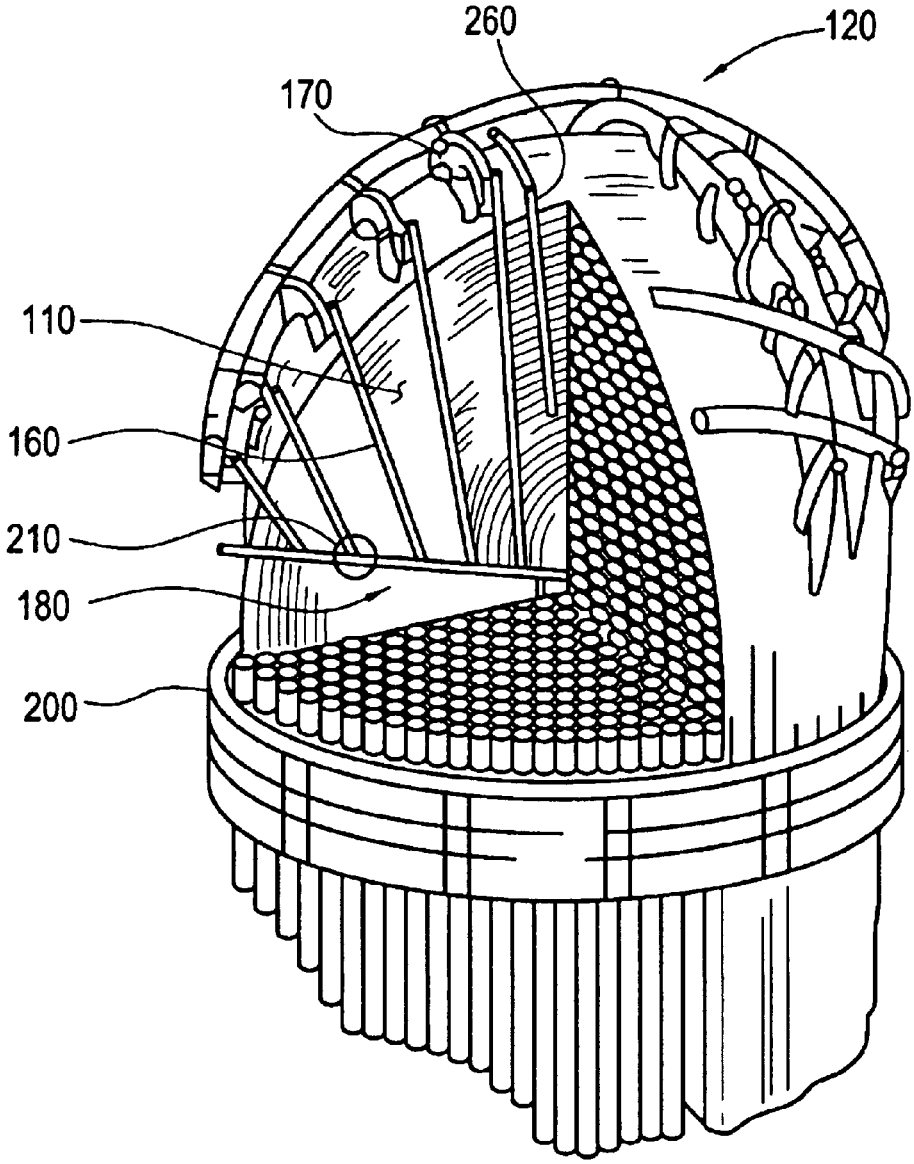
FIG. 6 is partially cut away perspective view of a U-bend support assembly using the improved tube support bar of the present invention according to an embodiment as an auxiliary support bar.

In another embodiment, the pocketed tube support bar 260 of the present invention can be used within an existing U-bend support assembly 120, as shown in FIG. 6, to provide additional support within the U-bend region of the tubes 110, and may also be used to replace existing support bars within a U-bend support assembly 120. For example, pocketed tube support bars 260 could be distributed within U-bend support bar arrays 180 with one bar placed between each layer of U-bend tubes. One or more arrays of such pocketed U-bend support bars 260 may be used. The longitudinal orientation of a pocketed U-bend support bar 260 may be radial, or some other direction with a radial component. The length of the pocketed U-bend support bar 260 may extend inwards from the periphery of the tube bundle to a point part way toward the smallest radius tube, as shown in FIG. 6, or may extend all of the way to the smallest radius tube. A U-bend support assembly 120 may also include pocketed U-bend support bars 260 sandwiched between two layers of tubes, and in each space between successive layers of tubes, so that pocketed U-bend support bars 260 are situated between each of the inter-tube layers extending from the middle of the bundle outward for some fraction, or for all of the inter-tube layers of the bundle.

The location, orientation and shape of the array of pockets as well as the cross sectional dimensions of the bars must be matched to the intended installation location. For a radial bar installation, in a steam generator with a uniform tube array, a uniform array of correctly sized pockets will be appropriate. For a non-radial orientation or a non-uniformly spaced tube array, the pocket array must be specifically tailored to suit the intended installation. FIG. 4 depicts an embodiment suitable for use in a staggered tube bundle, in which the pockets are longitudinally offset on opposite sides of tube support bar 260. For application to an in-line tube bundle, the pockets are instead longitudinally aligned, rather than offset, on opposite sides of tube support bar 260. While the pockets 60 and 60' are shown in the figures to be of cylindrical shape, each pocket could be formed with three or more flat surfaces, with the flat surfaces being parallel to the adjacent tube surface.

The pocketed tube support bars 260 are designed to be installed into an existing, fully-assembled steam generator tube bundle, either in addition to, or in place of, conventional flat U-bend support bars 160. Such retrofit assembly is not possible for other scalloped bars, corrugated bars or other bars shaped to provide restraint in the in-plane direction. By virtue of their unique design, the pocketed tube support bars 260 are suited for use in retrofit applications within a fully-assembled steam generator tube bundle, either before or after entering service. The pocketed tube support bars 260 are, however, equally suited for use in original equipment applications, layered between tubes as they are inserted into a new steam generator during manufacture.

The pocketed tube support bars 260 may be made with a variety of configurations and details as required for the specific application. For example, in a nuclear steam generator application in the U-bend region, tube support bars 260 may be of various widths as required for a particular design, and can range from about 1" or less to about 2" for some applications. The thickness of the tube support bar 260 is dictated by the space between adjacent layers of tubes, together with desired tube-to-bar clearance, and may vary from 0.1" or less to about 0.4". As a further example, pocketed tube support bars 260 may be made from 400 Series or 300 Series stainless steels, or possibly of other high alloy material or a low alloy steel, but other materials may also be suitable.

While specific embodiments and/or details of the invention have been shown and described above to illustrate the application of the principles of the invention, it is understood that this invention may be embodied as more fully described in the claims, or as otherwise known by those skilled in the art (including any and all equivalents), without departing from such principles. The present invention is not limited to the U-bend region of U-tube steam generators, and can be applied to provide in-plane and out-of-plane support to the straight-leg portion of the U-tubes of a U-tube steam generator.

The present invention is also not limited to U-tube steam generators, and can be used to provide in-plane and out-of-plane support to the tubes of a variety of heat exchangers including spiral tube heat exchangers or straight tube heat exchangers, such as shell-and-tube heat exchangers, and for a variety of applications in the process, energy and other industries.

I claim:

1. A support bar for use in a heat exchanger having rows of tubes arranged in a plurality of parallel tube planes defining en in-plane direction and an out-of-plane direction, comprising:

an elongated body with first and second sides, and first and second ends;

a first shoulder, extending along the first side adjacent the first end, and having a first plurality of pockets adapted for receiving a first row of tubes;

a second shoulder, extending along the second side adjacent the second end, and having a second plurality pockets adapted for receiving a second row of tubes;

wherein the pockets are designed to have a small clearance with the tubes after installation thereby restraining the tubes against motion in both the in-plane direction and the out-of-plane direction; and wherein the elongated body further comprises a parallelogram having a short diagonal and a long diagonal, a center located at the intersection of the short diagonal and the long diagonal, a first axis passing through the center, a first pair of parallel surfaces located on opposite sides at the first axis, a second axis passing through the center, and a second pair of parallel surfaces located on opposite sides of the second axis.

2. The support bar of claim 1, wherein the first plurality of pockets and the second plurality of pockets are longitudinally offset from one another.

3. The support bar of claim 1, wherein the pockets are substantially cylindrical.

4. The support bar of claim 1, wherein the support bar thickness along a line perpendicular to the second axis and passing through the center is selected to permit insertion between layers of tubes.

5. The support bar of claim 4, wherein the support bar thickness is about 0.1" to about 0.4".

6. The support bar of claim 4, wherein the first axis is aligned parallel to a tube plane.

7. The support bar of claim 4, wherein the second axis is aligned parallel to a tube plane.

8. The support bar of claim 1, wherein the first pair of parallel surfaces extend from adjacent the center to the first and second ends, and the second pair at parallel surfaces extend from adjacent the center to the first and second shoulders.

9. A support bar for use in the U bend region of a heat exchanger having rows of U-bend tubes arranged in a plurality of parallel U-bend tube planes defining an in-plane direction and an out-of-plane direction, comprising;

an elongated body with first and second sides, and first and second ends, the body having a cross sectional form generally in the shape of a parallelogram having a short diagonal and a long diagonal, a center located at the intersection of the short diagonal and the long diagonal, a first axis passing through the center, a first pair of parallel surfaces located on opposite sides of the first axis, a second axis passing through the center, and a second pair of parallel surfaces located on opposite sides of the second axis;

a first shoulder, extending along the first side adjacent the first end, and having a first plurality of pockets adapted to restrain a first row of U-bend tubes against motion in both the in-plane direction and the out-of-plane direction in the U-bend region;

a second shoulder, extending along the second side adjacent the second end, and having a second plurality of pockets longitudinally offset from the first plurality of pockets and adapted to restrain a second row of U-bend tubes against motion in both the in-plane direction and the out-of-plane direction in the U-bend region; and wherein the first and second shoulders each have shoulder sides parallel to the second axis, and inner and outer shoulder end surfaces perpendicular to the first axis.

10. The support bar of claim 9, wherein the support bar thickness in a direction perpendicular to the second axis is selected to permit insertion between layers of U-bend tubes.

11. The support bar of claim 10, wherein the pockets are substantially cylindrical.

12. The support bar of claim 11, wherein the first axis is aligned parallel to a U-bend tube plane.

13. The support bar of claim 11, wherein the second axis is aligned parallel to a U-bend tube plane.

14. A support bar for use in a nuclear steam generator having rows of tubes arranged in a plurality of parallel tube planes defining an in-plane and an out-of-plane direction, comprising:

an elongated body with first and second sides, and first and second ends, wherein the elongated body further comprises a parallelogram having a short diagonal and a long diagonal, a center located at the intersection of the short diagonal and the long diagonal, a first axis passing through the center, a first pair of parallel surfaces located on opposite sides of the first axis, a second axis passing through the center, and a second pair of parallel surfaces located on opposite sides of the second axis;

a first shoulder, extending along the first side adjacent the first end, and having a first plurality of pockets adapted for receiving a first row of tubes;

a second shoulder, extending along the second side adjacent the second end, and having a second plurality of pockets adapted for receiving a second row of tubes and:

means for restraining the tubes against motion in both an in-plane and an out-of-plane direction by aligning the tubes with the pockets of the support bar.

15. The support bar of claim 14, wherein the pockets are substantially cylindrical.

16. The support bar of claim 14, wherein the support bar thickness is about 0.1" to about 0.4".

17. The support bar of claim 14, wherein the first axis is aligned parallel to a tube plane.

18. The support bar of claim 14, wherein the second axis is aligned parallel to a tube plane.

19. A support bar for use in the U-bend region of a nuclear heat exchanger having rows of U-bend tubes arranged in a plurality of parallel U-bend tube planes defining an in-plane and an out-of-plane direction, comprising:

an elongated body with first and second sides, and first and second ends, wherein the body further comprises a parallelogram having a short diagonal and a long diagonal, a center located at the intersection of the short diagonal and the long diagonal, a first axis passing through the center, a first pair of parallel surfaces located on opposite sides of the first axis, a second axis passing through the center, and a second pair of parallel surfaces located on opposite side of the second axis;

a first shoulder, extending along the first side adjacent the first end, and having a first plurality of pockets adapted for receiving a first row of tubes;

a second shoulder, extending along the second side adjacent the second end, and having a second plurality of pockets adapted for receiving a second row of tubes; and means for restraining the tubes against motion in both an in-plane and an out-of-plane direction by aligning the tubes with the pockets of the support bar.

20. The support bar of claim 19, wherein the pockets are substantially cylindrical.

21. The support bar of claim 19, wherein the support bar thickness is about 0.1" to about 0.4".

22. The support bar of claim 19, wherein the first axis is aligned parallel to a tube plane.

23. The support bar of claim 19, wherein the second axis is aligned parallel to a tube plane.

* * * * *